US009284745B2

(12) United States Patent
Marco et al.

(10) Patent No.: US 9,284,745 B2
(45) Date of Patent: Mar. 15, 2016

(54) OUTDOOR MEMORIAL DISPLAY CASE

(71) Applicants: Nick Marco, Joliet, IL (US); David Welter, Braidwood, IL (US)

(72) Inventors: Nick Marco, Joliet, IL (US); David Welter, Braidwood, IL (US)

( * ) Notice: Subject to any disclaimer, the term of this patent is extended or adjusted under 35 U.S.C. 154(b) by 28 days.

(21) Appl. No.: 13/962,482

(22) Filed: Aug. 8, 2013

(65) Prior Publication Data

US 2015/0040443 A1 Feb. 12, 2015

(51) Int. Cl.

| | |
|---|---|
| ***G09F 7/18*** | (2006.01) |
| ***E04H 13/00*** | (2006.01) |
| ***G09F 7/00*** | (2006.01) |
| *G09F 7/20* | (2006.01) |

(52) U.S. Cl.

CPC ..... *E04H 13/003* (2013.01); *G09F 7/002* (2013.01); *G09F 7/18* (2013.01); *G09F 7/20* (2013.01); *G09F 2007/1817* (2013.01); *G09F 2007/1843* (2013.01)

(58) Field of Classification Search

CPC ..... G09F 7/18; G09F 7/20
USPC ..... 40/124.5, 607.01, 773, 765, 772, 780; 206/213, 216; 116/63 P, 63 T
See application file for complete search history.

(56) References Cited

U.S. PATENT DOCUMENTS

| | | | | |
|---|---|---|---|---|
| 2,110,768 | A * | 3/1938 | Kellogg | 40/643 |
| D149,294 | S | 11/1946 | Newman | |
| 2,535,149 | A | 12/1950 | McBride | |
| 2,841,272 | A | 9/1955 | Dreier | |
| D198,507 | S | 6/1964 | Ehle | |
| 4,879,145 | A | 11/1989 | McLellan et al. | |
| D310,454 | S | 9/1990 | Beasley | |
| D315,323 | S | 3/1991 | Bailey | |
| 5,056,657 | A | 10/1991 | Frye | |
| D323,257 | S | 1/1992 | Cornwell | |
| D380,108 | S | 6/1997 | Rodack | |
| 6,892,486 | B2 * | 5/2005 | Haggard, Jr. | 40/604 |
| D544,252 | S | 6/2007 | Grandstaff | |
| D545,242 | S | 6/2007 | Poteet | |
| D595,068 | S | 6/2009 | Edwards | |
| 2006/0016111 | A1 * | 1/2006 | Simmons | 40/607.04 |
| 2007/0193097 | A1 * | 8/2007 | Popowich et al. | 40/766 |
| 2010/0031546 | A1 * | 2/2010 | Nwatu | 40/607.1 |
| 2010/0043269 | A1 * | 2/2010 | Gipson | 40/783 |

* cited by examiner

*Primary Examiner* — Syed A Islam
(74) *Attorney, Agent, or Firm* — Depeng Bi; The Law Offices of Konrad Sherinian

(57) ABSTRACT

A memorial for outdoor display is disclosed. The memorial includes a post for mounting in the ground and a display case. The display case is further comprised of a frame and a center display. The frame comprises three pieces situated on the bottom, left and right of the display case. Each piece includes a groove along an interior surface. Adapted to fit within the groove are two components of the center display: a transparent face and a print. A backing member is adapted to be disposed on the back of the frame pieces.

7 Claims, 3 Drawing Sheets

OUTDOOR MEMORIAL DISPLAY CASE

CROSS REFERENCE TO RELATED APPLICATIONS

None

FIELD OF THE DISCLOSURE

The present invention generally relates to memorials and more particularly to an outdoor weatherproof memorial for displaying a commemorative image.

BACKGROUND

When a relative or loved one perishes, many survivors want to commemorate the deceased's achievements and life. Some common types of memorials include memorial urns, gravestone markers, simple shrines, and memorial display cases holding flags. Such memorials tend to be adapted for display indoors within a home or mausoleum or outdoors within a cemetery. However, there is no known memorial adapted for outdoor display for displaying a memorial sign at the home of a survivor.

OBJECTS OF THE DISCLOSED SYSTEM, METHOD, AND APPARATUS

Accordingly, it is an object of this disclosure to provide an improved outdoor memorial.

Another object of this disclosure is to provide an improved outdoor memorial for display at the home of a survivor of a deceased person.

Another object of this disclosure is to provide an improved outdoor memorial for display of a memorial sign.

Other advantages of this disclosure will be clear to a person of ordinary skill in the art. It should be understood, however, that a system or method could practice the disclosure while not achieving all of the enumerated advantages, and that the protected disclosure is defined by the claims.

SUMMARY OF THE DISCLOSURE

An improved memorial for outdoor display is disclosed. The memorial includes a wooden post for in-ground using, for example, a fence post mount, and a display case. The display case includes a frame and a center display. The frame comprises three pieces situated on the bottom, left and right of the display case. Each piece includes a groove along an interior surface. The center display comprises a print and a transparent face laid across the print. The combination of the print and transparent face are adapted to fit within the grooves on the interior surfaces of the bottom piece, left piece and right piece. A backing member is adapted to be disposed on the back of the frame pieces.

As the outdoor display is adapted for permanent or near-permanent use outdoors, the post, backing member, and frame pieces all will generally be constructed of weather proof materials. Some examples include weather treated wood, corrosion treated metals, and fiberglass. The transparent face will also need to be constructed of a weather proof material such as acrylic, clear fiberglass or tempered glass.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION

Figure 1:
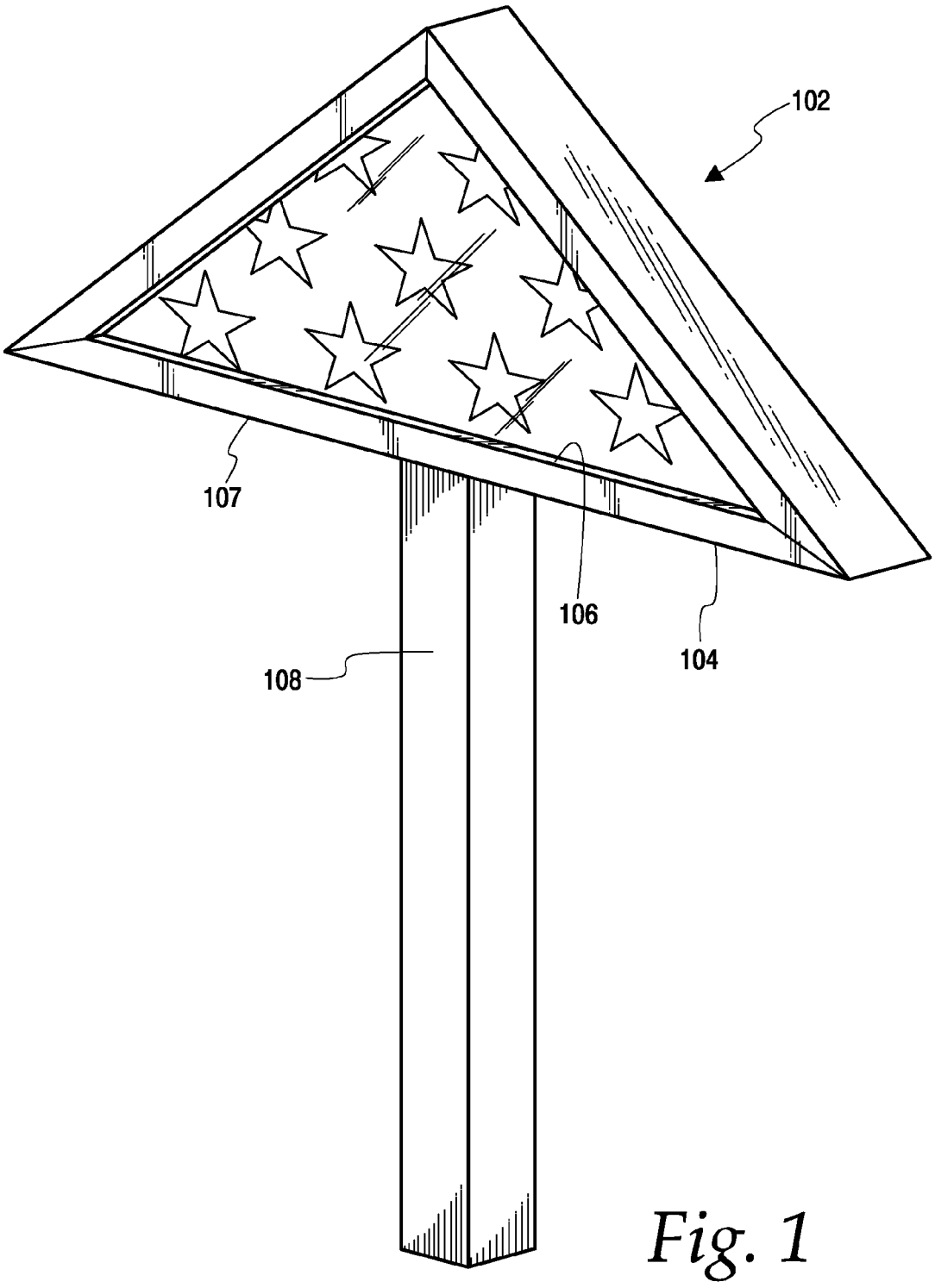
FIG. 1 is a perspective diagram of an improved outdoor memorial constructed in accordance with this disclosure.

Turning to the Figures and to FIG. 1 in particular, an outdoor memorial 100 adapted to display a sign, a print, or other memorial display. The outdoor memorial 100 comprises a post 108 that is connected to a lower surface 107 of a display case 102. The display case comprises a frame 104 and a center display 106. The disclosed outdoor memorial 100 is further explained in FIGS. 2*a* and 2*b*.

Figure 2A:
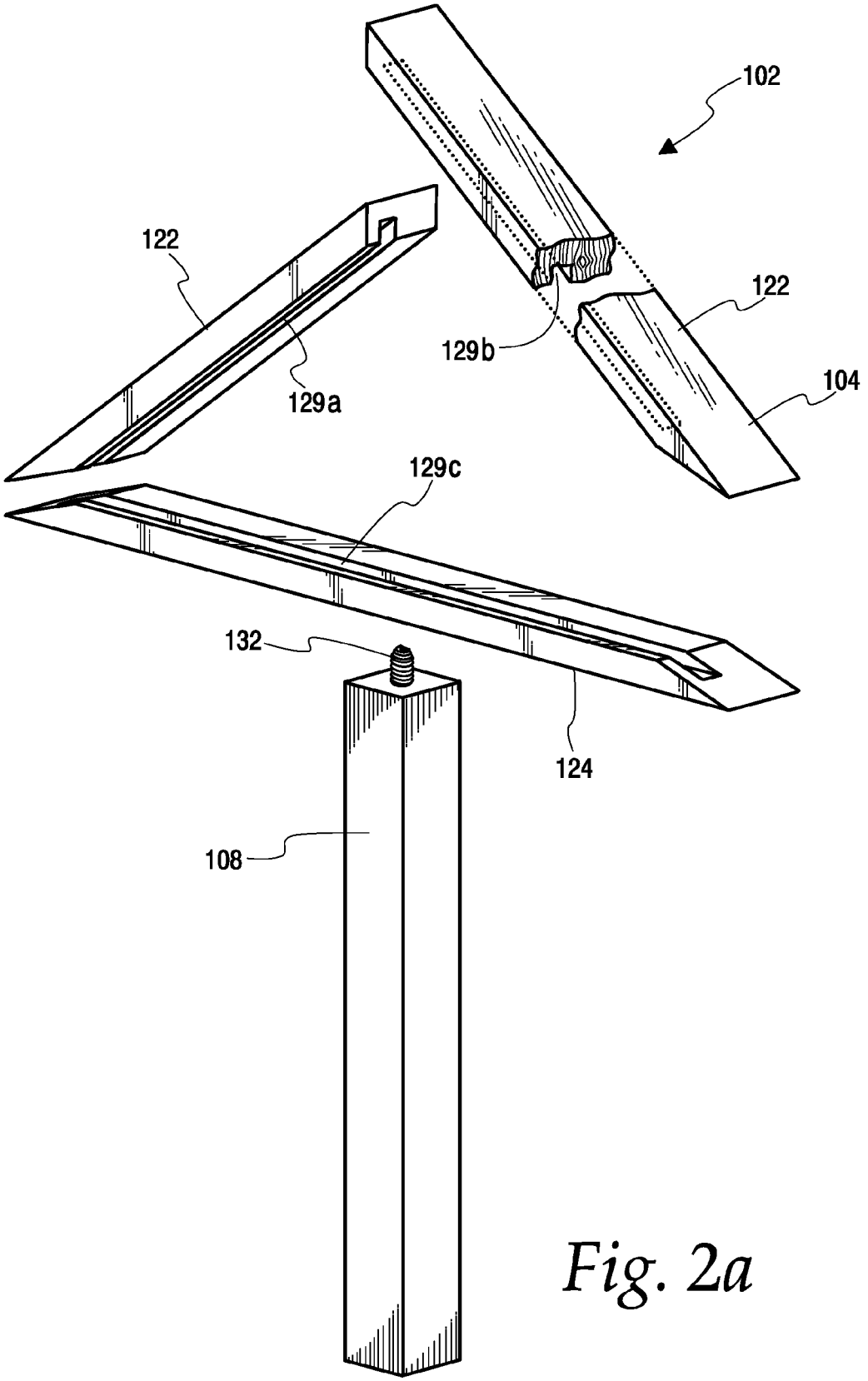
FIG. 2*a* is an exploded perspective diagram of the frame an improved outdoor memorial constructed in accordance with this disclosure.

Turning to FIG. 2*a*, an exploded view of the post 108 and frame 104 of the outdoor memorial 100 is depicted. The post 108 can be, for example, substantially longitudinal and constructed of, for example, a weather treated wood, such as weather treated oak, weather treated red cedar, a wood that a weather sealer has been applied to, a corrosion treated metal, such as zinc phosphate coated steel, fiberglass, or even a durable plastic. However, the post 108 should be capable of substantially permanent mounting in, for example, soil. The mounting methods may vary, although one preferred method would be to dig a hole approximately two to three feet deep into which a fence post socket (not shown) is driven into the bottom. The post 108 could then be mounted into the fence post socket and the hole filled with concrete. Other substantially permanent mounting methods could also be used.

The post 108 is joined to the frame 104 by a threaded bolt 132. The bottom piece 124 of the frame 104 has mated threads 127 as depicted in FIG. 2*c*, which is a bottom view of the bottom piece 124 of the frame 104. The mated threads 127 may be implemented by, for example, a metallic element implanted into the bottom piece 124. The frame 104 also incorporates two upper pieces 122 and 126, comprising the remainder of the triangular shape. All frame pieces 122,124,126 incorporate a groove 129*a*,129*b*,129*c* in the center of their interior surfaces to hold the center display components 106 of the display case 102. The frame pieces 122,124,126 may be constructed of, for example, weather treated wood, such as a weather treated red cedar, a corrosion treated metal, fiberglass, or even a durable plastic.

However, as the disclosed memorial is intended for outdoor use, the material should be capable of permanent or near permanent display outdoors.

Figure 2B:
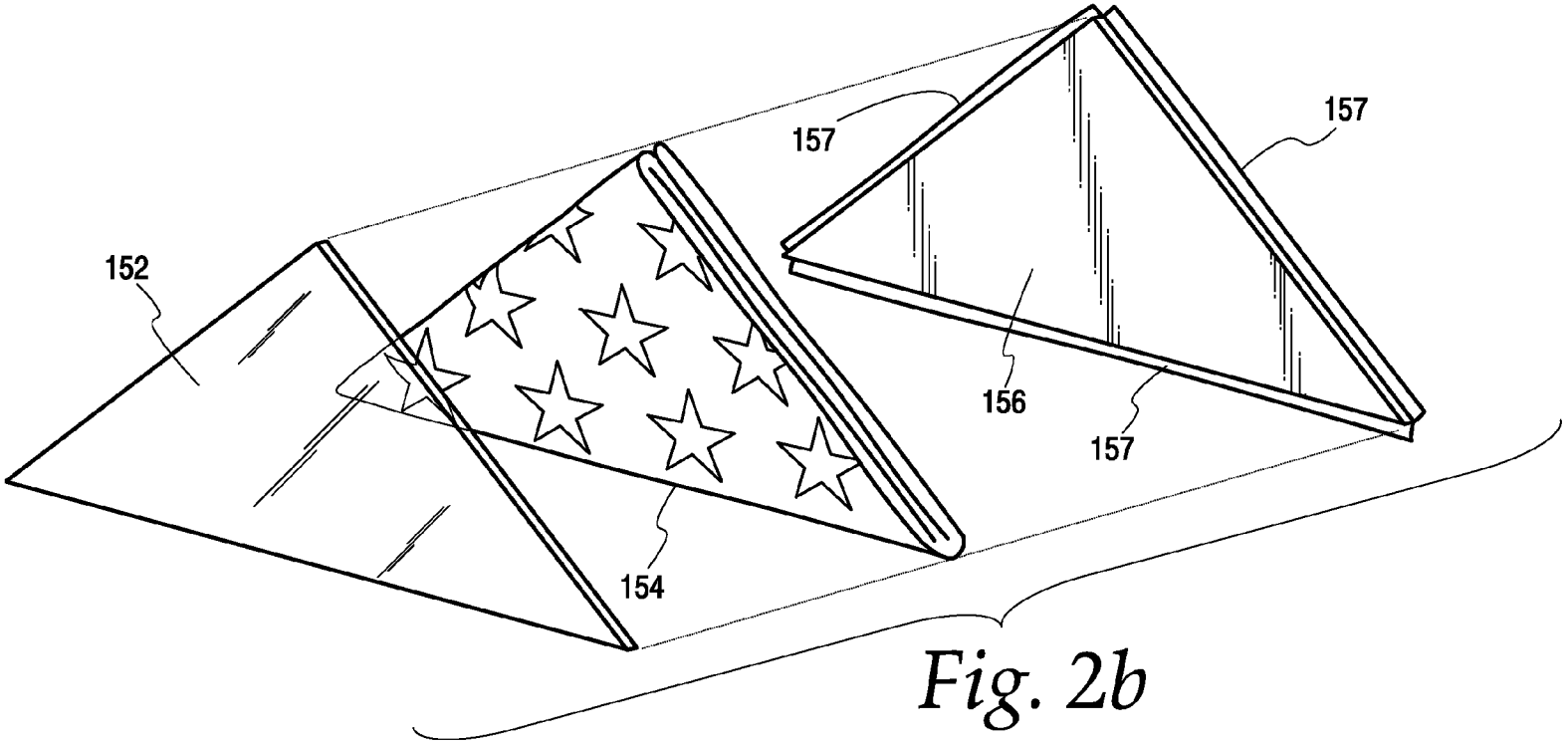
FIG. 2*b* is an exploded perspective diagram of the display of an improved outdoor memorial constructed in accordance with this disclosure.
Figure 2C:
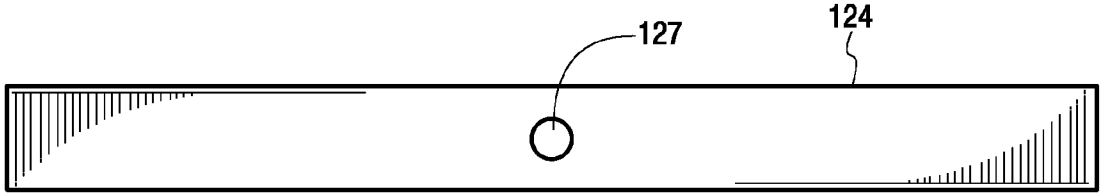
FIG. 2*c* is a bottom view of a bottom piece of a frame incorporated within an improved outdoor memorial constructed in accordance with this disclosure.

Turning to FIG. 2*b*, the center display 106 incorporates three components. The first component is a substantially triangular transparent face 152. The transparent face 152 may be constructed of, for example, fiberglass, a transparent polycarbonate resin thermoplastic, acrylic, or tempered glass. However, the transparent face 152 is intended to remain transparent and functionally sound permanently or near permanently in an outdoor environment, which restricts the choice of materials to those that are sufficiently durable to meet this standard. In addition, the transparent face 152 can be Ultraviolet (UV) resistant, to prevent the contents of the center display 106 from fading. Behind the transparent face 152 is a substantially triangular print 154. The print 154 displays a memorial sign. For example, if the deceased for whom the outdoor memorial 100 is dedicated was a serviceman or servicewoman, the print 154 may be adapted to appear similar to a folded American Flag displayed in an Memorial Flag Case. Other designs may also be used; for example, a memorial to a fireman may include an image of a fire hydrant or fire engine. Other memorial images may be used as well. The print 154 can be constructed of a durable, aesthetically pleasing material, such as, for example, vinyl. The substantially triangular back of the print 154 may comprise an adhesive to aid in coupling to the back 156 of the center display 106.

The back 156 of the center display 106 is adapted to hold cover the rear of the center display 106 and protect the print 154. The back 156 can be constructed any suitable material that can withstand placement in an outdoor environment permanently or semi-permanently. Examples would be, for example, weather treated wood, corrosion treated metal, fiberglass, and even durable plastics. The back is affixed to the frame 104, by, for example, weatherproof tape strips 157.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A memorial for outdoor display comprising:

i. a post adapted to be mounted outdoors, the post constructed out of a weather resistant material;

ii. the post including a metallic bolt extruding from a top end of the post, the metallic bolt comprising a set of threads;

iii. a display comprised of a triangular frame and a triangular center display;

iv. the triangular frame comprised of a bottom edge, a left edge, and a right edge wherein each of the bottom edge, the left edge, and the right edge is constructed of a weather resistant material, and wherein each of the bottom edge, the left edge, and the right edge respectively comprise a back surface and an interior surface, wherein each of the interior surfaces incorporates a groove disposed along substantially the full length of the interior surface, the grooves of the bottom edge, the left edge, and the right edge are arranged in a triangular configuration, and wherein the bottom edge, left edge, and right edge are arranged in a triangular configuration;

v. the bottom edge further comprising a metallic insert including a second set of threads, the second set of threads adapted to mate with the set of threads of the metallic bolt;

vi. the triangular center display comprising a print, and a transparent face, the print and the transparent face disposed within the groove of the bottom edge, the groove of the left edge, and the groove of the right edge; and vii. the triangular center display further comprising a backing member, the backing member being affixed to the back surface of the bottom edge, the back surface of the left edge, and the back surface of the right edge.

2. The memorial of claim 1 wherein the post is constructed of a weather treated wood, and wherein the bottom edge, left edge, and right edge are also constructed of a weather treated wood.

3. The memorial of claim 1 wherein the bottom edge, left edge, and right edge are constructed of a corrosion treated metal.

4. The memorial of claim 1 wherein the transparent face is constructed of fiberglass.

5. The memorial of claim 1 wherein the transparent face is constructed of acrylic.

6. The memorial of claim 1 wherein the transparent face is constructed of tempered glass.

7. The memorial of claim 1 wherein the backing member is affixed to the bottom edge, the left edge, and the right edge by one or more strips of weather proof tape.

* * * * *